United States Patent [19]

Kumamoto et al.

[11] Patent Number: 5,037,797

[45] Date of Patent: Aug. 6, 1991

[54] ACCEPTOR COATED SHEET FOR PRESSURE-SENSITIVE COPYING SYSTEM

[75] Inventors: Hiroshi Kumamoto, Amagasaki; Shinsuke Irii, Kobe; Tomoharu Shiozaki, Amagasaki, all of Japan

[73] Assignee: Kanzaki Paper Manufacturing Company, Limited, Tokyo, Japan

[21] Appl. No.: 380,668

[22] Filed: Jul. 17, 1989

[30] Foreign Application Priority Data

Jul. 18, 1988 [JP] Japan ..... 63-179917

[51] Int. Cl.[5] ..... B41M 5/155

[52] U.S. Cl. ..... 503/214; 427/150; 503/209; 503/210; 503/216; 503/225

[58] Field of Search ..... 427/150–152; 503/210–212, 209, 216, 214, 225

[56] References Cited

U.S. PATENT DOCUMENTS 3,900,215 8/1975 Kato et al. ..... 503/212

FOREIGN PATENT DOCUMENTS 2021172 11/1979 United Kingdom ..... 503/225

*Primary Examiner*—Bruce H. Hess

*Attorney, Agent, or Firm*—Larson and Taylor

[57] ABSTRACT

Disclosed is an acceptor coated sheet for pressure-sensitive copying system comprising a base sheet and an acceptor layer disposed thereon, said acceptor layer being formed from an acceptor coating composition comprising (a) at least one immobilizing agent selected from the group consisting of the sulfates, nitrates, acetates and formates of zinc, aluminum and magnesium, (b) a latex of copolymer containing an unsaturated carboxylic acid as a monomer component and, if necessary, a water-soluble binder, (c) an organic acceptor, and (d) at least one pigment selected from the group consisting of zinc oxide, magnesium oxide, titanium oxide, aluminum hydroxide, calcium carbonate, calcium sulfate and kaolin.

16 Claims, No Drawings

ACCEPTOR COATED SHEET FOR PRESSURE-SENSITIVE COPYING SYSTEM

This invention relates to an acceptor coated sheet for pressure-sensitive copying sheet and more particularly to an acceptor coated sheet for pressure-sensitive copying sheet having an evenly coated surface free from mottling.

Usually the so-called 'pressure-sensitive copying system' consists of three kinds of basic sheets such as top sheet, middle sheet and bottom sheet, wherein the top sheet is coated on the underside thereof with a composition consisting mainly of pressure-rupturable microcapsules each enclosing an oily core material containing an electron donating organic chromogenic material (hereinafter referred to as "color former") dissolved or dispersed therein, the middle sheet is coated on the upperside thereof with another composition consisting mainly of an electron accepting acidic reactant material (hereinafter referred to as "acceptor") which can produce a colored image upon contact with the color former and also is coated on the underside thereof with the composition of microcapsules containing oil droplets in which a color former is dissolved or dispersed and the bottom sheet is coated on the upperside thereof with a composition of an acceptor. One top sheet and one bottom sheet or, one top sheet, at least one middle sheet and one bottom sheet are superposed in that order to form a set of copying sheet. Another well-known version of pressure-sensitive sheet is a self-contained type pressure-sensitive copying system which enables copying with a single sheet carrying a color former and an acceptor on the same side. Of these systems, each of the middle sheet, the bottom sheet and the self-contained type sheet has an acceptor layer and, as such, falls within the category of acceptor coated sheet for pressure-sensitive copying system.

The acceptor coated sheet is generally prepared by coating a base sheet with a coating composition containing an organic or inorganic acceptor, a binder, a pigment, etc. by means of a coating machine. However, depending on the coating amount, viscosity of the coating composition, method of coating, the degree of sizing of base sheet, etc., uneven coating (i.e. mottling) tends to occur so that not only the finished appearance is adversely affected but, due to the unevenly coated surface, color smudge due to friction with the top sheet (hereinafter referred to as "frictional smudge") tends to develop, and printability is also affected.

The incidence of such uneven coating is much dependent on the degree of sizing of the base sheet used and compared with acidic sizing paper, neutral sizing paper tends to be unevenly sized and hence is liable to develop the problem of uneven coating.

Recently, to ensure an extended archiving. life of documents, neutral sizing paper is often used in lieu of acidic sizing paper which has been commonly employed, and in the field of pressure-sensitive copying sheet, too, it is by now demanded to use neutral sizing paper and to form an acceptor layer free of the problem of uneven coating.

An object of this invention is to provide a pressure-sensitive acceptor coated sheet having an evenly formed acceptor layer, improved resistance to frictional smudge and satisfactory printability.

This invention provides an acceptor coated sheet for pressure-sensitive copying system comprising a base sheet and an acceptor layer formed over the base sheet, said acceptor layer being formed by applying to the base sheet a coating composition comprising:

(a) at least one immobilizing agent selected from the group consisting of the sulfates, nitrates, acetates and formates of zinc, aluminum and magnesium, (b) a latex of a copolymer comprising an unsaturated carboxylic acid as a monomer component and, if necessary, a water-soluble binder, (c) an organic acceptor, and (d) at least one pigment selected from the group consisting of zinc oxide, magnesium oxide, titanium oxide, aluminum hydroxide, calcium carbonate, calcium sulfate and kaolin.

The intensive research of the inventor of this invention revealed that the use of the above-specified immobilizing agent (a), latex of copolymer comprising an unsaturated carboxylic acid as a monomer component (b) and pigment (d) in combination with an organic acceptor (c) provides an acceptor coated sheet for pressure-sensitive copying system which can overcome the above-mentioned disadvantages of uneven coating and frictional smudge and which can insure satisfactory printability. This invention is accomplished based on the above finding.

The base sheet which can be used in the invention includes neutral sizing paper, acidic sizing paper, synthetic paper, etc. However, the effect of preventing uneven coating according to this invention is best exploited when neutral sizing paper is employed. The term 'acidic sizing paper' means the paper produced by adding a filler, size, dye, etc. to a pulp slurry and using aluminum sulfate as a fixing agent and forming a web from the pulp slurry controlled to a pH value of about 4 to 5. The term 'neutral sizing paper' means the paper produced by adding a filler, size, fixing agent, dye, etc. to a pulp slurry and forming a web from the pulp slurry controlled to neutral to alkaline pH range, namely pH 6 to 9. Also included in the category of neutral sizing paper are a neutral medium-grade paper containing about 10 weight % of high yield pulp such as bleached chemithermomechanical pulp and a coated neutral sizing paper carrying an ordinary pigment composition layer on the side opposite to the side to be coated with the acceptor composition.

According to the understanding of the inventor of this invention, the phenomenon of uneven coating is closely associated with the rate of absorption of the vehicle, e.g. water, contained in the coating composition into the base sheet and, therefore, occurs due to the non-uniform absorption of the vehicle. When the above-mentioned immobilizing agent is incorporated in the acceptor layer coating composition according to this invention, the viscosity and other rheological characteristics of the coating composition are modulated to eliminate the non-uniformity of absorption of the vehicle with the consequent formation of an evenly formed acceptor layer. The above is a hypothesis, however, and further investigation is in order for full clarification of the phenomena involved.

The immobilizing agents which can be used as component (a) of this invention are the salts of zinc, aluminum, magnesium, etc. and among these salts, sulfates, nitrates, acetates and formates are particularly suited for the purposes of this invention.

Of these immobilizing agents, zinc sulfate, aluminum sulfate, zinc acetate, magnesium sulfate and zinc formate are preferred. Sulfates such as zinc sulfate, aluminum sulfate and magnesium sulfate are more preferred. These immobilizing agents may be used either singly or in combination.

The proportion of the immobilizing agent is 0.05 to 20 parts by weight, preferably 0.1 to 10 parts by weight, per 100 parts by weight of the pigment and acceptor combined. If the proportion is less than 0.05 part by weight, the effect of preventing uneven coating may not be realized, while the use of more than 20 parts by weight of the immobilizing agent may result in an increased viscosity of the coating composition to detract from its applicability.

A water-dispersible binder or a water-soluble binder is generally incorporated in this type of coating composition. In the coating composition of this invention, a latex of a copolymer comprising an unsaturated carboxylic acid as a monomer component is used as an essential binder (b). This latex undergoes interaction with the above-mentioned immobilizing agent to produce the effect of preventing uneven coating.

The latex of copolymer containing an unsaturated carboxylic acid as a monomer component (b) is a latex prepared by using at least one unsaturated carboxylic acid, particularly unsaturated aliphatic carboxylic acids, including monocarboxylic acids such as acrylic acid, methacrylic acid, etc. or dicarboxylic acids such as fumaric acid, itaconic acid, maleic acid, etc., as a monomer component. As examples of said latex, there may be mentioned the copolymer latices obtainable by using at least one of said unsaturated carboxylic acids and at least one comonomer selected from the group consisting of conjugated dienes, acrylic monomers and vinyl monomers. Butadiene is typical of said dienes. The acrylic monomers include, among others, alkyl or monohydroxyalkyl esters, particularly $C_1$–$C_8$ alkyl or monohydroxyalkyl esters, of acrylic or methacrylic acid, and further include acrylamide, methacrylamide, acrylonitrile and methacrylonitrile. The vinyl monomers include styrene, ethylene, vinyl acetate, divinylbenzene and so on. Thus, particularly useful are latices of conjugated diene copolymer such as unsaturated carboxylic acid-styrene-butadiene copolymers and unsaturated carboxylic acid-methyl methacrylate-butadine copolymers; latices of acrylic copolymer including copolymers of an unsaturated carboxylic acid and at least one species of alkyl (particularly $C_1$–$C_8$ alkyl or monohydroxyalkyl) esters of acrylic or methacrylic acid; and latices of vinyl copolymer such as unsaturated carboxylic acid-ethylene-vinyl acetate copolymers. These copolymer latices can be used singly or in combination. Stated more specifically, examples of the copolymer latices useful in the invention are, for example, latices of acrylic acid-styrene-butadiene copolymer, itaconic acid-styrene-butadiene copolymer, acrylic acid-acrylamide-styrene-butadiene copolymer, acrylic acid-methyl methacrylate-styrene-butadiene copolymer, acrylic acid-methyl methacrylate-acrylonitrile-styrene-butadiene copolymer, acrylic acid-fumaric acid-methyl methacrylate-styrene-butadiene copolymer, acrylic acid-itaconic acid-methyl methacrylate-styrene-butadiene copolymer, acrylic acid-itaconic acid-methyl methacrylate-hydroxyethyl acrylate-divinylbenzene-styrene-butadiene copolymer, acrylic acid-methyl methacrylate-divinylbenzene-butadiene copolymer, acrylic acid-methyl methacrylate-butadiene copolymer, acrylic acid-methyl methacrylate-acrylonitrile-butadiene copolymer, methacrylic acid-butyl acrylate copolymer, acrylic acid-butyl acrylate-2-ethylhexyl acrylate copolymer, acrylic acid-ethylene-vinyl acetate copolymer, methacrylic acid-ethylene-vinyl acetate copolymer, and the like. The proportions of the constituent monomer components can be suitably selected depending on the required properties. From the view point of preventing uneven coating, the proportion of the unsaturated carboxylic acid is preferably about 1 to 15% by weight, more preferably about 2 to 10% by weight, based on the amount of the total monomer components.

The above copolymer latex is preferably incorporated in an amount of 3 to 30 parts by weight and, for still better results, about 6 to 20 parts by weight, per 100 parts by weight of the pigment and acceptor combined, calculated as solids.

If necessary, the coating composition may additionally contain at least one member of water-soluble binders such as starch, casein, gum arabic, carboxymethylcellulose, polyvinyl alcohol, etc. Among such water-soluble binders, those binders which contain carboxyl groups are particularly beneficial in that they undergo interaction with said immobilizing agent to improve the surface characteristics of the acceptor layer. When a water-soluble binder is used in combination with said latex of copolymer containing an unsaturated carboxylic acid as a monomer component, such a water-soluble binder is preferably used in a proportion of about 3 to 25 parts by weight per 100 parts by weight of the pigment and acceptor combined.

As acceptors useful for pressure-sensitive copying sheets, there may be mentioned various inorganic acceptors such as acid clay, activated clay, zeolite, bentonite, silica, aluminum silicate, etc. and organic acceptors such as phenolic polymers, e.g. phenol-aldehyde, phenol-acetylene and other polymers, aromatic carboxylic acids and polyvalent metal salts thereof and so on. For the purposes of this invention, organic acceptors are preferred from the standpoint of color development and the archiving life of records.

Examples of the organic acceptor (c) that can be used in the invention include the various acceptors mentioned in Examined Japanese Patent Publications No. 0856/1974 and No. 25174/1976 and Japanese laid-open Patent Application (KOKAI) No. 55410/1974, viz. aromatic carboxylic acids such as benzoic acid, p-tert-butylbenzoic acid, 4-methyl-3-nitrobenzoic acid, salicylic acid, 3-phenylsalicylic acid, 3-cyclohexylsalicylic acid, 3-tert-butyl-5-methylsalicylic acid, 3,5-di-tert-butylsalicylic acid, 3-methyl-5-benzylsalicylic acid, 3-phenyl-5-(α,α-dimethylbenzyl)salicylic acid, 3-cyclohexyl-5-(α,α-dimethylbenzyl)salicylic acid, 3-(α,α-dimethylbenzyl)-5-methylsalicylic acid, 3,5-dicyclohexylsalicylic acid, 3,5-di-(α-methylbenzyl)salicylic acid, 3,5-di-(α,α-dimethylbenzyl)salicylic acid, 3-(α-methylbenzyl)-5-(α,α-dimethylbenzyl)salicylic acid, 4-methyl-5-cyclohexylsalicylic acid, 2-hydroxy-1-benzyl-3-naphthoic acid, 1-benzoyl-2-hydroxy-3-naphthoic acid, 3-hydroxy-5-cyclohexyl-2-naphthoic acid, 2-hydroxy-4-[(4-carboxy-5-hydroxy)phenyl]-1-naphthoic acid, etc. and the corresponding salts of polyvalent metals such as zinc, aluminum, magnesium, calcium, cobalt, etc.; the acceptors mentioned in Examined Japanese Patent Publications No. 9309/1965 and No. 20144/1967 and Japanese laid-open Patent Application (KOKAI) No. 14409/1973, viz. phenolic compounds such as 6,6'-methylenebis(4-chloro-m-cresol), etc., phenolic resins such as phenol-aldehyde resins, e.g. p-phenylphenol-formaldehyde resin etc., and phenol-acetylene resins, e.g. p-tert-butylphenol-acetylene resin etc.

and the corresponding salts of polyvalent metals, and acidic polymers such as maleic acid-rosin resin, copolymers of styrene, ethylene, vinyl methyl ether and maleic anhydride, and the acceptors mentioned in Examined Japanese Patent Publications No. 8215/1973, No. 8216/1973 and No. 1326/1977, namely polymers of aromatic carboxylic acids with aldehyde or acetylene and polyvalent metal salts thereof. Of these organic acceptors, said polyvalent metal salts of aromatic carboxylic acids are particularly preferred. The amount of the acceptor to be used is about 5 to 25 weight percent based on the total solids content of the acceptor layer.

The acceptor layer of the invention contains, as component (d), a pigment, such as zinc oxide, magnesium oxide, titanium oxide, aluminum hydroxide, calcium carbonate, calcium sulfate, kaolin and so on. Of these pigments, pigments other than kaolin, particularly zinc oxide, magnesium oxide, titanium oxide, aluminum hydroxide, calcium carbonate, calcium sulfate, etc. are preferred since they do not interfere with color development. Of these preferred pigments, zinc oxide, titanium oxide and calcium carbonate are more desirable. While the particle size of the pigment may be anywhere between the limits commonly accepted in the art of pressure-sensitive copying sheet, the average particle size thereof is preferably within the range of about 0.1 to 10 μm, more preferably about 0.1 to 5 μm. The generally preferred proportion of the pigment is about 40 to 90 percent by weight of the total solids content of the acceptor layer.

If necessary, the acceptor layer of this invention may contain various additives which are commonly employed in the art, such as a defoaming agent, antiseptic agent, fluorescent dye, coloring dye, etc.

The coating composition for forming the acceptor layer can be prepared by any of the known techniques conventionally employed in the art.

The organic acceptor is generally dispersed in water in a: pulverizer such as a sand mill, ball mill, attriter or the like to give an aqueous dispersion or alternatively dissolved in an organic solvent and emulsified in water with an emulsifier or dispersing agent such as polyvinyl alcohol, followed by removal of the organic solvent by steam distillation. Then, the pigment, binder immobilizing agent and the like are added to prepare a coating composition.

The concentration of solids in the coating composition is not so critical and can be suitably selected from a broad range. However, in consideration of the ease of coating and the uniformity of acceptor layer, the range of about 20 to 50 weight percent is preferred.

The acceptor coating composition thus prepared is applied, in a single layer or multiple layers, to a base sheet by means of an on-machine or off-machine coating apparatus provided with a blade coater, air-knife coater, roll coater, size press coater, curtain coater, bar coater, Champflex coater, short-dwell coater or the like.

Coating one side of the base sheet with the acceptor coating composition of this invention provides a bottom sheet carrying an acceptor layer on one side only. On the other hand, a middle sheet can be obtained by coating one side of the base sheet with this acceptor coating composition and the other side with a color former microcapsule composition. The color former microcapsule composition may be any of the compositions heretofore used in the preparation of a pressure-sensitive copying sheet and, for example, the color former microcapsule composition described in U.S. Pat. No. 2,800,457, U.S. Pat. No. 2,800,458, U.S. Pat. No. 3,516,941, U.S. Pat. No. 4,001,140 and U.S. Pat. No. 4,087,376, Examined Japanese Patent Publications No. 771/1967 and No. 33475/1988 can be used with advantage. Furthermore, using the above acceptor coating composition and a color former microcapsule composition, a self-contained pressure-sensitive sheet can be prepared by the conventional method described, for example, in Japanese laid-open Patent Applications (Kokai) No. 89815/1979 and No. 10489/1981.

The coating amount of the acceptor coating composition of this invention is dependent on which of the bottom sheet, middle sheet and the self-contained pressure-sensitive sheet is desired. The coating amount should, of course, be the amount effective to give a color image when the acceptor is brought into contact with a color former by application of pressure in each copying system. Generally speaking, the proper coating amount, on a dry basis, of the acceptor coating composition of this invention is about 3 to 7 g/m$^2$ for the bottom sheet, about 2 to 5 g/m$^2$ for the middle sheet, and about 3 to 7 g/m$^2$ for the self-contained system.

The following examples and comparative examples are further illustrative of this invention and should by no means be construed as limiting its scope. It should be understood that all parts and percents shown are by weight unless otherwise indicated.

EXAMPLES 1 THROUGH 8 AND COMPARATIVE EXAMPLES 1 AND 2

Preparation of the acceptor coating composition

In 100 parts of toluene was dissolved 100 parts of zinc 3,5-di-(α-methylbenzyl)salicylate and using a homomixer, the solution was emulsified in 150 parts of a 3% aqueous solution of polyvinyl alcohol. The toluene was then removed by steam distillation to provide an aqueous dispersion of fine acceptor particles. This aqueous dispersion was mixed with 700 parts of calcium carbonate, 100 parts of aluminum hydroxide, 100 parts of zinc oxide, 200 parts of a 25% aqueous solution of oxidated starch and 208 parts of an acrylic acid-butadiene-methyl methacrylate (2:33:65%) copolymer latex (48% dispersion) and the resulting dispersion was diluted with water to give a coating composition with a solids content of 30%.

To aliquots of this coating composition were added varying amounts, based on the combined weight of the pigment and acceptor, of various immobilizing agents as shown in Table 1 to prepare acceptor coating compositions with a uniform solids content of 25%.

In Example 8, the procedure of Example 1 was followed except that an acrylic acid-itaconic acid-methyl methacrylate-styrene-butadiene (1.5/1.5/4.5/57.5/35%) copolymer latex was used in place of the acrylic acid-butadiene-methyl methacrylate copolymer latex.

In Comparative Example 1, the procedure of the above Examples was followed except that none of the immobilizing agents were used. In Comparative Example 2, the same procedure was followed except that a butadiene-methyl methacrylate (35:65%) copolymer latex containing no acrylic acid was used in lieu of said acrylic acid-butadiene-methyl methacrylate copolymer latex.

Production of pressure-sensitive acceptor coated sheets

To a pulp suspension prepared by admixing 20 parts of NBKP (450 ml in Canadian standard freeness) and 80 parts of LBKP (450 ml in Canadian Standard freeness) were added, per 100 parts of the pulp, 5 parts of natural ground calcium carbonate, 0.1 part of alkyl ketene dimer size, 0.5 part of cationic starch acting as a fixing agent and 0.02 part of cationic retention aid to prepare a paper stock. A web was formed from the paper stock by means of Fourdrinier paper machine, and an aqueous solution of oxidized starch (tradename "Ace A", product of Oji Corn Starch, Japan) was applied to the web in an amount of 1.5 g/m$^2$ based on a dry basis with use of a size press, followed by machine calendering, thereby giving neutral sizing paper sheet weighing 40 g/m$^2$.

Using an air knife coater, one side of the above neutral sizing paper sheet was coated with one of the above acceptor coating compositions to give a coating layer with a dry weight of 5 g/m$^2$, followed by drying to provide a pressure-sensitive acceptor coated sheet.

Preparation of the top sheet

Into an agitating device equipped with a heating means was placed 150 parts of 3% aqueous solution of ethylene-maleic anhydride copolymer (tradename "EMA31", product of Monsanto Industrial Chemicals, U.S.A) and the solution was adjusted to a pH of 4.0 to provide an aqueous medium for the preparation of microcapsules.

Separately, 100 parts of alkylnaphthalene (tradename "KMC Oil", product of Kureha Kagaku Kabushiki Kaisha, Japan) was dissolved in 5 parts of crystal violet lactone, and the solution as the core material to be encapsulated was emulsified in the above aqueous medium such that the average particle size of the oily droplets dispersed in the resulting emulsion would be 4.0 $\mu$m.

Then, a melamine-formaldehyde prepolymer solution prepared by adding 10 parts of melamine to 30 parts of formalin and heating the mixture at 60° C. was added to the above emulsion maintained at 60° C., and the resulting mixture was heated to a temperature of 70° C. and stirred for 3 hours to effect reaction. Thereafter the mixture was cooled to room temperature, thereby producing microcapsules wherein the wall thereof was made of melamine-formaldehyde resin.

To the microcapsule dispersion thus obtained were added 70 parts of wheat starch powder and 20 parts (calculated as solids) of an oxidized starch solution each per 100 parts of the core material encapsulated in the microcapsules to prepare a microcapsule coating composition.

One side of a base sheet was coated with the above microcapsule coating composition to give a coating layer with a dry weight 4 g/m$^2$, followed by drying to provide a top sheet.

Tests

The pressure-sensitive acceptor coated sheets prepared as above were subjected to the following tests. The results are set forth in Table 1.

(1) Evaluation of coating uniformity (uneven coating)

The acceptor coated sheet and the top sheet were juxtaposed with the coated sides facing each other and pressed at a pressure of 60 kg/cm$^2$ to develop the color and the degree of uneven coating on the acceptor coated sheet was visually evaluated on the following 5-grade scale.

* Evaluation scale

5 . . . Even
4 . . . Slightly uneven
3 . . . Uneven but acceptable for practical use
2 . . . Uneven and not acceptable for practical use
1 . . . Quite uneven (2) Frictional smudge test The acceptor coated sheet and the top sheet were juxtaposed with the coated sides facing each other and shifted relative to each other 5 times under a pressure of 4 kg/cm$^2$ and the degree of color smudge on the acceptor coated sheet was visually evaluated.

Evaluation criteria:

A: Little smudged
B: Smudged (3) RI dry picking

Using an RI printability testing machine (Akira Seisakusho, Japan), a printing ink (black) with a tack value of 13 (product of Dainippon Ink and Chemicals, Inc., Japan) was applied three times to the entire surface of the coated side of the acceptor coated sheet and the degree of dusting (i.e., portions of coated layer picked off by the ink that can be observed as white dust on the black-colored printing roll) was organoleptically evaluated on the following 5-grade scale.

* Evaluation scale

5 . . . No dust
4 . . . Slight dust
3 . . . Dusting but acceptable for practical use
2 . . . Dusting and not acceptable for practical use
1 . . . Marked dusting (4) RI wet picking Using an RI printability testing machine (Akira Seisakusho, Japan), the same procedure as the RI drying picking test was followed except that wetting water was used.

* Evaluation scale

5 . . . No dust
4 . . . Slight dust
3 . . . Dust but acceptable for practical use
2 . . . Dust and not acceptable for practical use
1 . . . Marked dusting

TABLE 1

| | Immobilizing agent | Amount (%) | Coating uniformity | Frictional smudge | RI picking Dry | RI picking Wet |
|---|---|---|---|---|---|---|
| Example 1 | Zinc sulfate | 1 | 5 | A | 5 | 5 |
| Example 2 | Aluminum sulfate | 2 | 5 | A | 5 | 5 |
| Example 3 | Zinc acetate | 0.5 | 4 | A | 5 | 5 |
| Example 4 | Magnesium sulfate | 1 | 5 | A | 5 | 5 |
| Example 5 | Zinc formate | 1 | 4 | A | 5 | 5 |
| Example 6 | Zinc sulfate | 0.07 | 3 | A | 4 | 4 |
| Example 7 | Zinc acetate | 15 | 4 | B | 4 | 4 |

TABLE 1-continued

| | Immobilizing agent | Amount (%) | Coating uniformity | Frictional smudge | RI picking Dry | RI picking Wet |
|---|---|---|---|---|---|---|
| Example 8 | Zinc sulfate | 1 | 5 | A | 5 | 5 |
| Comparative Example 1 | None | none | 1 | B | 3 | 3 |
| Comparative Example 2 | Zinc sulfate | 1 | 1 | B | 2 | 2 |

It will be apparent from Table 1 that the acceptor coated sheets for pressure-sensitive copying system of this invention respectively have an even coated surface, are resistant to frictional smudge, and have satisfactory printability.

What is claimed is:

1. An acceptor coated sheet for pressure-sensitive copying system comprising a base sheet of neutral sizing paper and an acceptor layer disposed thereon, said acceptor layer being formed from an acceptor coating composition comprising (a) at least one immobilizing agent selected from the group consisting of the sulfates, nitrates, acetates and formates of zinc, aluminum and magnesium, (b) a latex of a copolymer containing an unsaturated carboxylic acid as a monomer component, (c) an organic acceptor, and (d) at least one pigment selected from the group consisting of zinc oxide, magnesium oxide, titanium oxide, aluminum hydroxide, calcium carbonate and calcium sulfate.

2. An acceptor coated sheet according to claim 1 wherein said immobilizing agent is at least one member selected from the group consisting of zinc sulfate, aluminum sulfate, zinc acetate, magnesium sulfate and zinc formate.

3. An acceptor coated sheet according to claim 1 wherein said immobilizing agent is zinc sulfate, aluminum sulfate or magnesium sulfate.

4. An acceptor coated sheet according to claim 1 wherein said immobilizing agent is used in an amount of about 0.05 to 20 parts by weight per 100 parts by weight of said organic acceptor (c) and pigment (d) combined.

5. An acceptor coated sheet according to claim 1 wherein said immobilizing agent is used in an amount of about 0.1 to 10 parts by weight per 100 parts by weight of said organic acceptor (c) and pigment (d) combined.

6. An acceptor coated sheet according to claim 1 wherein said copolymer comprises at least one member selected from the group consisting of unsaturated monocarboxylic acids and unsaturated dicarboxylic acids and at least one comonomer selected from the group consisting of conjugated dienes, acrylic monomers and vinyl monomers.

7. An acceptor coated sheet according to claim 1 wherein said copolymer comprises at least one unsaturated carboxylic acid selected from the group consisting of acrylic acid, methacrylic acid, fumaric acid, itaconic acid and maleic acid and at least one comonomer selected from the group consisting of butadiene, alkyl and monohydroxyalkyl methacrylates, alkyl and monohydroxyalkyl acrylates, acrylamide, methacrylamide, acrylonitrile, methacrylonitrile, styrene, ethylene, vinyl acetate and divinylbenzene.

8. An acceptor coated sheet according to claim 1 wherein said latex of copolymer is used in an amount of about 3 to 30 parts by weight per 100 parts by weight of said organic acceptor (c) and pigment (d) combined, calculated as solids.

9. An acceptor coated sheet according to claim 1 wherein said latex of copolymer is used in an amount of about 6 to 20 parts by weight per 100 parts by weight of said organic acceptor (c) and pigment (d) combined, calculated as solids.

10. An acceptor coated sheet according to claim 1 wherein said organic acceptor is selected from the group consisting of polyvalent metal salts of aromatic carboxylic acids.

11. An acceptor coated sheet according to claim 1 wherein said organic acceptor is used in an amount of about 5 to 25 parts by weight relative to the total solids content of the acceptor layer.

12. An acceptor coated sheet according to claim 1 wherein said pigment is at least one member selected from the group consisting of zinc oxide, magnesium oxide, titanium oxide, aluminum hydroxide, calcium carbonate and calcium sulfate.

13. An acceptor coated sheet according to claim 1 wherein said pigment is used in an amount of about 40 to 90 weight percents based on the total solids content of the acceptor layer.

14. An acceptor coated sheet according to claim 1 wherein the latex of a copolymer containing an unsaturated carboxylic acid as a monomer component is used in combination with a water soluble binder.

15. An acceptor coated sheet according to claim 14 wherein said water-soluble binder is at least one member selected from the group consisting of starch, casein, gum arabic, carboxymethylcellulose and polyvinyl alcohol.

16. An acceptor coated sheet according to claim 14 wherein said water-soluble binder is used in an amount of about 3 to 25 parts by weight per 100 parts by weight of said organic acceptor (c) and pigment (d) combined.

* * * * *